United States Patent [19]

Swanson et al.

[11] Patent Number: 5,008,594

[45] Date of Patent: Apr. 16, 1991

[54] SELF-BALANCING CIRCUIT FOR CONVECTION AIR IONIZERS

[75] Inventors: Ralph W. Swanson, Brunswick; Daniel F. Gagnon, Westbrook; Donald G. Parent, Windham, all of Me.

[73] Assignee: Chapman Corporation, Portland, Me.

[21] Appl. No.: 311,711

[22] Filed: Feb. 16, 1989

[51] Int. Cl.[5] ..... H05F 3/06

[52] U.S. Cl. ..... 315/111.81; 250/423 R; 361/213; 361/230; 361/231; 361/235

[58] Field of Search ..... 315/111.81; 250/423 R; 361/213, 230, 231, 235

[56] References Cited

U.S. PATENT DOCUMENTS

| | | | |
|---|---|---|---|
| 3,308,343 | 3/1967 | Smith et al. | 361/235 X |
| 3,308,344 | 3/1967 | Smith et al. | 361/235 X |
| 4,319,302 | 3/1982 | Moulden | 361/231 X |
| 4,415,947 | 11/1983 | Dryczynski et al. | 361/235 |
| 4,872,083 | 10/1989 | Blitshteyn | 361/230 X |

*Primary Examiner*—Eugene R. Laroche
*Assistant Examiner*—Do Hyun Yoo
*Attorney, Agent, or Firm*—Joseph S. Iandiorio

[57] ABSTRACT

A self-balancing circuit for convection air ionizers with a passively balanced ion emitter and collector including a circuit in which the ion emitter and the collector are capacitively isolated from external charge sources or sinks for maintaining balance in the positive and negative charge for producing a zero average current flow and a charge balanced ionized airstream.

10 Claims, 1 Drawing Sheet

SELF-BALANCING CIRCUIT FOR CONVECTION AIR IONIZERS

FIELD OF INVENTION

This invention relates to an airstream ionizer for neutralizing static charge on objects within the airstream, and more particularly, to a circuit which automatically and passively causes the unit to emit equal amounts of positive and negative ions creating an ion balance in the air stream exiting the unit.

BACKGROUND OF INVENTION

Air ionizers which emit a flow of positively and negatively charged ions have to date, proven most effective in neutralizing accumulated static charge on a non-conductive object within the ionized airstream. Typically, airstream ionizers place a high voltage potential on one or more emitter points to initiate the ionization process or corona, in the hopes of emitting an airstream containing an equal number of positive and negative ions. Measurements have shown, however, that various factors influence the generation of a balanced ion stream and cause the ionizer to output an airstream which is itself charged. For example, the greater mobility of negative ions, and ground planes formed by the metal case of the ionizer in close proximity to the emitters, cause an imbalance in the positive and negative ions emitted by the ionizer. This charge imbalance is subsequently transferred to any object in the path of the airstream, thereby adding to the problem that the air ionizer was designed to eliminate. In addition, dirt on the emitter points as well as humidity in the air affect the ionization process.

Various mechanical techniques are known to balance the production of positive and negative ions delivered by the ionizer at a given moment under given conditions. Such techniques include adjusting the position of the emitters relative to the collector or using external sensors and feedback mechanisms. However, continuously changing environmental conditions as well as the constant accumulation of dirt on the emitters make these approaches ineffective.

Attempts have been made to achieve a passively balanced ionized air stream by causing the ion emitters to give off positive and negative ions equally. In such a system, the one or more emitter points are capacitively isolated from the high side of an AC power source. Although negative ions are generally easier to produce and can be produced at lower voltages because of the physics involved in air ionization, a system utilizing capacitively coupled emitters overcomes this excess negative ion production. In such a system, the emitter points become slightly positively charged. This positive charge adds algebraically to the positive charge present during the positive going portion of the AC waveform, thus producing more positive ions. The increased production of positive ions continues until an equal number of positive and negative ions are generated.

Even though the emitter circuit is now generating a balanced amount of positive and negative ions, it has been found that the charge of the ionized airstream exiting the ionizer is not balanced.

SUMMARY OF INVENTION

It is therefore an object of this invention to provide an automatically self-balancing air ionizer which emits a truly balanced ionized airstream under all operating conditions.

It is a further object of this invention to provide a self-balancing air ionizer which balances the ion collection to insure constant ion balance in the air stream.

It is a still further object of this invention to provide a reliable self-balancing air ionizer which passively balances the ionized airstream thereby reducing the cost and complexity of the system.

This invention results from the realization that ions exiting an air ionizer are collected unevenly, thus introducing an imbalance in the ionized airstream, and from the further realization that in order to balance an ion collector circuit, the collector circuit must be isolated from all external sources or sinks of charge, thereby preventing an excess of positive or negative charge from building up in the circuit and subsequently being emitted into the airstream.

This invention features a self-balancing circuit for convection air ionizers including one or more ion emitter points and an ion collector. The emitter points and the collector are isolated from external charge sources and sinks for maintaining balance in the positive and negative charge emitted from the emitter points and collected by the collector, for maintaining a charge balanced ionized airstream.

In one embodiment, the emitter points and collector are isolated from external charge sources and sinks by a first capacitor means in series with the emitter points. Also included is a second capacitor in series with the collector and ground. Alternatively, the air ionizer may include a circuit in which the emitter points and collector are united in one ungrounded circuit and a capacitor isolates the emitter points and collector from external charge sources of sinks for maintaining charge balance. In addition, an isolation transformer isolates the AC power source from the emitter and collector circuit.

DESCRIPTION OF PREFERRED EMBODIMENT

Other objects, features and advantages will occur from the following description of a preferred embodiment and the accompanying drawings, in which.

A self-balancing air ionizer according to this invention may be accomplished by providing an energy source for placing a voltage potential between one or more ion emitter points and an ion collector. A fan or other airflow device provides an airstream flowing past the ion emitter points and ion collector. The air ionizer also includes isolation means for isolating the emitter points and the collector from external charge sources, for maintaining a balanced positive and negative ionized air stream. The isolation means may include capacitor means in series with the emitter and with the collector. Alternatively, the capacitor means may be placed between an ungrounded emitter-collector circuit and ground. The isolation means may also include an isolation transformer as well as a non-metallic air ionizer enclosure.

Figure 1:
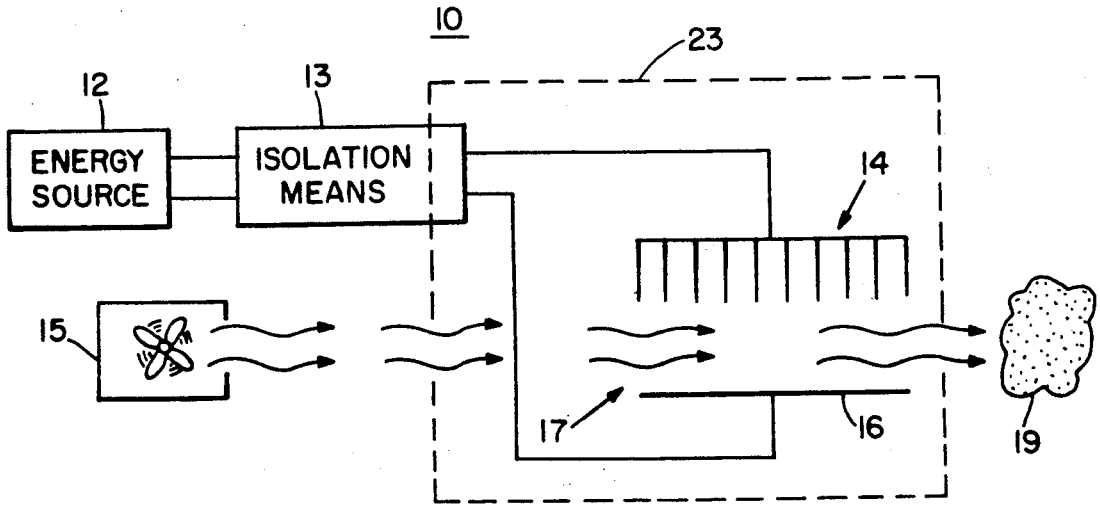
FIG. 1 is a block diagram of a self-balancing air ionizer according to this invention.

A self-balancing air ionizer 10. FIG. 1, includes energy source 12 which provides a voltage potential between emitter points 14 and collector 16 to promote ionization. Air flow source 15 provides a constant source of air 17 flowing past emitter points 14 and collector 16. Airflow 17 is directed towards charged object 19, whose static charge is to be neutralized. Isolation means 13 isolates emitter points 14 and collector 16 from energy source 12 as well as other external charge sources or sinks. Isolation means 13 may also include insulative enclosure 23 which completely surrounds emitters 14 and collector 16 to prevent any object near the ionizer from acting as an unwanted ion collector.

Figure 2:
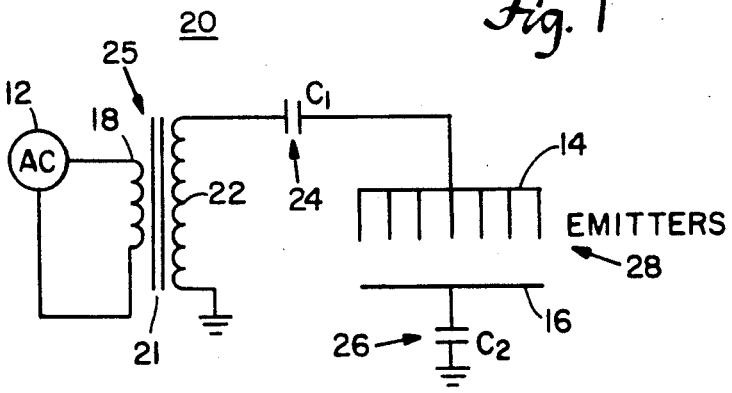
FIG. 2 is a schematic representation of a self-balancing ion emitter and collector according to this invention.

A self-balancing air ionizer circuit 20, FIG. 2, includes AC power source 12 for providing a high voltage potential of typically 5000 volts between emitter points 14 and collector 16. Primary collector 16 may be a solid sheet of metal material placed near the ion emitter and parallel with the airflow so as not to interfere with the airflow characteristics. In addition, collector 16 may be any surface within the unit that airborne ions give up their charge to. First capacitor 24 is in series with emitter points 14 and secondary winding 22 of transformer 25; while second capacitor 26 is connected in series between collector 16 and ground. AC power source 12 is connected to primary winding 18 of transformer 25. Secondary winding 22 charges capacitor 24 and places a voltage potential between emitter points 14 and collector 16. Between primary winding 18 and secondary winding is transformer core 21.

Air has naturally occurring positive and negative ions in equal numbers, and is therefore normally in a balanced condition. Placing a high voltage potential between emitter points 14 and collector 16, however, initiates ionization. This ionization process occurs when a voltage potential is placed between two adjacent locations. Once ionization is initiated, the accelerated movement of the ions or free electrons during their attraction and repulsion from the charged emitter points and collector, causes them to collide with other molecules, thus creating more ions. This avalanche effect continues up to a maximum limit.

Insuring that an equal number of ions are produced by emitter 14, however, does not insure that an equal number of positive and negative ions are emitted into the airstream. Since the ions must travel past collector 16 when exiting the ionizer, most ions are lost to the oppositely charged collector. Further, since negative ions are more mobile, it has been found that if the collector is held at ground potential, more negative ions are lost to the collector than positive ions. By providing capacitor 26 in the collector circuit, the capacitor stores the negative charge and attracts more positive ions and repels more negative ions until a balance is achieved.

Balancing of the ions emitted and lost to the collector plate takes place over a minimum number of cycles with a steady state condition being achieved within a few seconds time.

Figure 3:
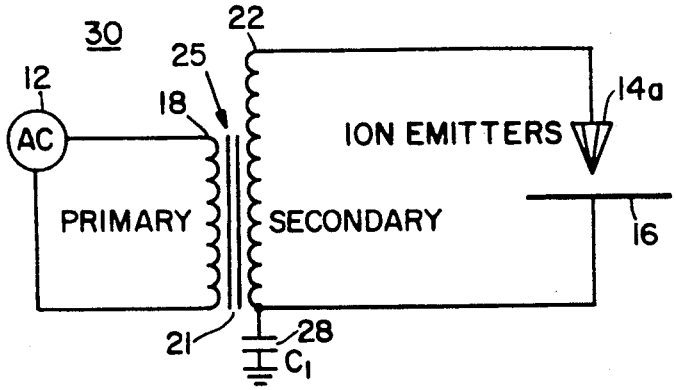
FIG. 3 is a schematic view of an another embodiment of a balanced air ionizer according to the present invention using only a single capacitor.

An additional embodiment of a self-balancing air ionizer circuit 30, FIG. 3, includes AC power source 12, primary winding 18 and secondary winding 22. Secondary winding 22 is isolated from transformer core 21. Ion emitter point **14*a* and collector 16 are connected directly to secondary winding 22 of transformer 25. To prevent any extraneous charges from entering the circuit from ground which would unbalance the ionized airstream, capacitor 28 is connected between the circuit and ground. In this way, no charge may flow to an adjoining grounded point such as might occur between the transformer high voltage windings and the transformer core, if the voltage on the windings near the core exceed the isolation value of the transformer. Any imbalance in the circuit results in a charge stored on capacitor 28** and serves as a restoring force or negative feedback during the next AC cycle of opposite polarity.

Figure 4:
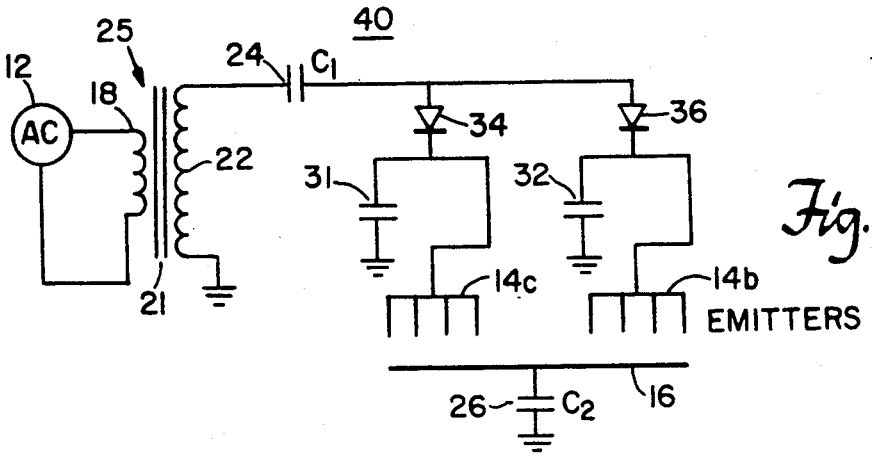
FIG. 4 is a schematic representation of yet another embodiment of a balanced air ionizer according to the present invention with separate positive and negative emitters.

Another embodiment of a self-balancing air ionizer circuit 40, FIG. 4, includes AC power source 12 and transformer 25 having primary winding 18 and secondary winding 22. Although similar in operation to the circuit in FIG. 1, rectifier diode 34 allows emitter points **14*c* to charge positively during the positive cycle of the AC wave form; while rectifier diode 36 allows emitter points 14*b* to charge negatively during the negative cycle of the AC wave form. Capacitors 24 and 26 serve to balance the ion production and collection of emitters 14*b* and 14*c* as well as collector 16. Since emitters 14*b*, 14*c* and collector 16 are isolated from other ambient conducting sources or sinks, any net charge exiting by means of the front air exit results in a restoring force or feedback charge accumulating on capacitors 24 or 26, and no net charge flows to or from ground. Capacitors 31 and 32 serve to filter or smooth out the rectified voltage applied to positive emitters 14*c* and negative emitters 14*b***.

Although specific features of the invention are shown in some drawings and not others, this is for convenience only as each feature may be combined with any or all of the other features in accordance with the invention.

Other embodiments will occur to those skilled in the art and are within the following claims:

What is claimed is:

1. A self-balancing air ionizer circuit with inherently passively balanced ion emission comprising:

at least one ion emitter point;

ion collector means adjacent to and spaced from said at least one emitter point;

means for providing an air flow past said emitter point;

means for providing voltage potential between said at least one emitter point and said collector means; and means for isolating said at least one emitter point and said collector means from external charge sources and sinks, for maintaining charge balance in the positive and the negative ions emitted from said at least one emitter and collected by said collector for producing a charge balanced ionized airstream wherein said means for isolating and maintaining charge balance includes at least one capacitor means in series with the collector means and ground.

2. The self-balancing air ionizer of claim 1 in which the means for isolating and maintaining charge balance includes first capacitor means in series with said at least one emitter point and second capacitor means in series with the collector means and ground.

3. The self-balancing air ionizer of claim 1 in which the voltage source, the at least one emitter point and the collector are united in one ungrounded circuit arrangement and the means for isolating and maintaining charge balance includes capacitor means connected between the circuit arrangement and ground.

4. The self-balancing air ionizer of claim 3 in which the isolation means includes an isolation transformer.

5. The self-balancing air ionizer of claim 4 in which the means for isolating further includes a non-metallic enclosure surrounding the circuit.

6. The self-balancing air ionizer of claim 1 in which the means for providing a voltage potential includes means for providing an AC voltage potential having a positive and negative cycle.

7. The self-balancing air ionizer of claim 6 in which the emitter includes at least two sections, a first section energized during the positive cycle of said AC voltage and a second section energized during the negative cycle of said AC voltage.

8. The self-balancing air ionizer of claim 7 further including means for controlling conduction of said first emitter section during said positive cycle and means for controlling conduction of said second emitter section during said negative cycle.

9. A self-balancing air ionizer circuit with inherently passively balanced ion emission comprising:

one or more ion emitter points;

ion collector means adjacent to and spaced from said emitter points;

means for providing an air flow past said emitter points;

means for providing voltage potential between said emitter points and said collector means; and means for isolating said emitter points and said collector means from external charge sources and sinks including first capacitor means in series with the emitter points and second capacitor means in series with the collector means and ground.

10. A self-balancing air ionizer circuit with inherently passively balanced ion emissions comprising:

one or more ion emitter points;

ion collector means adjacent to and spaced from said emitter points;

means for providing an air flow past said emitter points;

means for providing a voltage potential between said emitter points and said collector means; and means for maintaining charge balance including first capacitor means in series with the emitter points and second capacitor means in series with the collector means for maintaining a charge balanced ionized airstream.

* * * * *